US005558768A

United States Patent [19]

Ikura et al.

[11] Patent Number: 5,558,768

[45] Date of Patent: Sep. 24, 1996

[54] PROCESS FOR REMOVING CHLORIDES FROM CRUDE OIL

[75] Inventors: Michio Ikura, Kanata; Maria Stanciulescu, Orleans, both of Canada

[73] Assignee: Energy, Mines and Resources Canada, Ottawa, Canada

[21] Appl. No.: 370,639

[22] Filed: Jan. 10, 1995

[51] Int. Cl.[6] ..... C10G 33/00; C10G 17/00; B01D 1/00; B01D 19/00

[52] U.S. Cl. ..... 208/187; 208/188; 208/262.1; 208/281; 95/154; 95/150; 95/182; 210/703; 210/708

[58] Field of Search ..... 208/187, 188, 208/262.1, 287; 95/154, 150, 182; 210/703, 708

[56] References Cited

U.S. PATENT DOCUMENTS

| | | | |
|---|---|---|---|
| 2,820,759 | 1/1958 | Monet | 210/44 |
| 2,964,478 | 12/1960 | Monson | 252/331 |
| 3,140,257 | 7/1964 | Wilder et al. | 210/51 |
| 3,205,169 | 9/1965 | Kirkpatrick et al. | 252/8.55 |
| 3,487,003 | 12/1969 | Baillie et al. | 208/11 |
| 3,808,120 | 4/1974 | Smith | 208/11 |
| 3,950,245 | 4/1976 | Ailey et al. | 208/187 |
| 4,058,453 | 11/1977 | Patel et al. | 208/188 |
| 4,261,812 | 4/1981 | Newcombe | 208/188 |
| 4,272,360 | 6/1981 | Bialek | 208/188 |
| 4,396,499 | 8/1983 | McCoy et al. | 208/188 |
| 4,596,653 | 6/1986 | Graham et al. | 208/188 |
| 4,602,326 | 7/1986 | Bialek | 208/188 |
| 4,806,231 | 2/1989 | Chirinos et al. | 208/262.1 |
| 4,895,641 | 1/1990 | Briceno et al. | 208/286 |
| 4,900,452 | 2/1990 | Angles et al. | 210/706 |
| 4,992,210 | 2/1991 | Naeger et al. | 208/262.1 |
| 5,055,196 | 10/1991 | Darian et al. | 208/262.1 |
| 5,080,802 | 1/1992 | Cairo, Jr. et al. | 210/703 |
| 5,256,305 | 10/1993 | Hart | 210/708 |
| 5,407,585 | 4/1995 | Taylor et al. | 208/188 |

*Primary Examiner*—Anthony McFarlane
*Assistant Examiner*—Patricia L. Hailey

[57] ABSTRACT

A process is described for removing chlorides from crude oils, including heavy oils and bitumens. The process steps comprise (1) mixing a non-ionic surfactant with the crude oil, (2) bubbling a gas into the crude oil-surfactant mixture to form a froth, (3) centrifuging the frothed mixture to obtain a chloride containing sediment and an oil product of reduced chloride content and (4) collecting the oil product.

11 Claims, No Drawings

PROCESS FOR REMOVING CHLORIDES FROM CRUDE OIL

BACKGROUND OF THE INVENTION

This invention relates to a process for removing chlorides from crude petroleum.

Crude oils, including heaving oils and bitumen, are generally found in reservoirs in associating with salt water and gas. As the reservoir becomes depleted, the oil/water interface in the reservoir rises and at some stage, water is coproduced with the oil.

The mixture of water and oil is subjected to a high degree of turbulence during production and these actions form an emulsion in which water droplets are dispersed throughout the crude oil phase. The presence of indigenous surfactants in the crude oil also stabilizes the emulsion by forming a rigid interfacial layer which prevents the water droplets from contacting an coalescing with one another.

Crude oils may, in fact, contain a variety of organic and inorganic contaminants which have detrimental effects on process equipment and operation of a refinery. Organic contaminants may cause unpredictable rates of corrosion in processing equipment and organic contaminants are also a major problem. Normally crude oil contains about 0.01–1% by weight or more of basic sediment, i.e. finely divided sediment. These are water insoluble, inorganic sediments such as sand, silt, clay and gypsum. Although they are relatively inert, they are extremely abrasive. Particle sizes of the basic sediment ranges from 20 to 200 μm. Large particles can be centrifuged from the crude oil and small particles can be separated from the crude oil by electrostatic desalting operations.

In addition, crude oil may contain small particles of metal oxides and sulphide salts termed "filterable solids" They are typically 1 to 20 μm in diameter and insoluble in oil and water. They tend to accumulate at the water/oil interface and act to stabilize the emulsions. These cannot readily be removed from crude oil in a desalting operation without adding an appropriate water wetting agent.

The saline or brine water combined with the crude oil contains various alkali salts forming part of the water/oil emulsion. A typical brine water may contain sodium, calcium, magnesium and potassium in the form of chlorides. Alkali metals are much more concentrated in brine than in sea water and, for example, sodium ions are two to eight times more concentrated in oil field brine water than in sea water. Although the water-in-oil emulsions are stabilized by a large number of contaminants, normal desalting by fresh water removes most of the salts. Sodium hydroxide, often used in crude oil pretreatment, readily reacts with naphthenic acid to form sodium napthenates that contribute to emulsion stabilization.

Ordinarily, commercial desalting operations can remove most of the water soluble contaminants (salts, acids, bases) water insoluble contaminants (basic sediment and filterable salts) and brine water from the crude. Remaining sodium chloride is thermally stable at the temperatures found in the traditional refinery operations, such as crude and vacuum unit furnaces, and has not been a serious problem.

However, with the recent trend of using hydrogenation technologies for upgrading heavy oils, there has arisen a need to reduce the chloride level in the oils to as low as a few ppm. Chloride ion, if accumulated to a certain level, may cause corrosion which is often characterized by the premature failure of reactors and associated vessels. Particularly when a high pressure and temperature hydrogenation process is used, it is essential to assure a very low chloride level in the feed oils.

As noted above, chloride reduction from crude oil may be achieved by removing chloride retaining water droplets. When water droplets are removed, the chloride level comes down as well. Water reduction processes are commonly known as "dehydration" processes. There are several commercial dehydration technologies in use in refineries as follows:

1. Gravity Separation with Demulsifier

Gravity can induce phase separation when a chemical destabilizer (demulsifier) is added to the water-laden crude. The separation is accomplished in large tanks which provide sufficient residence time, often in the order of hours and even days.

2. Gravity Separation with Demulsifier and Viscosity Reduction

The settling velocity of water droplets can be increased by heating the crude oil to reduce the oil viscosity in which water droplets settle by gravity.

3. Centrifugation

The application of centrifugal force can also accelerate the settling velocity of water droplets by increasing effective gravitational field.

4. Gravity Separation with Demulsifier and an Electrostatic Field

The application of high alternative voltage electrostatic field (typically 4 to 5 kilovolts/cm) induces charge separation upon a water surface. As a result, any two adjacent water droplets will collide by attractive force and grow to a larger water droplet, and thus reducing residence time to tens of minutes instead of hours and days. Water droplets may grow from 5 μm to 100 μm, resulting in rapid dehydration.

Although the petroleum industry may employ a variety of techniques (chemical, mechanical or electrical) singly or in combination to effect separation of gross amounts of water from production fluids, the electrostatic approach is almost always selected to remove salt and sediment down to the lowest level required for refining. A typical desalting process uses water-washing followed by induced dipole coalescence and precipitation. This involves the addition of a small amount (typically 5 vol %) of a low chloride water to the crude oil, followed by the intimate mixing of the added water into the oil so as to create a fine dispersion of fresh water droplets among the residue brine droplets and sediment in the crude oil, and finally introducing this dispersion into an intense electric field which accelerates coalescence of the dispersed water droplets and brine droplets, resulting in rapid phase separation. This combination removes 90 to 95% of the incoming salt down to 10 ppm Cl level. Even lower levels can be achieved if two stage desalting (double desalting) is used. An additional 80 to 90% desalting can be achieved resulting in 0.5 to 1.0 ppm Cl levels. However, the double desalting process requires substantial capital expenditures.

When a brine-in-oil emulsion is extremely small, i.e. microemulsion or micelle, it becomes extremely stable and the normal gravitation methods of separation do not work. Even if a centrifuge is used, either processing time or centrifugal force must be substantially increased, or a combination of both of these must be used. This is because the settling rate of a water droplet-through oil is proportional to power two of the droplet diameter. Thus, if the droplet diameter is only one-tenth of a reference droplet, the settling rate of the smaller droplet is only one-hundredth of that of the reference droplet. The settling rate of a droplet through oil is also linearly proportional to the gravitational force. This means that the centrifugation on the smaller droplet must increase by 100 times in order to match the settling rate of the reference droplet.

The application of an electrostatic field normally works well by growing brine droplets by coalescence. When an alternating electric field is applied to the water droplets dispersed in oil, dipole appears on the droplet surface. As the electric field alternates, the droplets begin to oscillate through the oil at different velocities depending on the droplet diameters. This results in the collision of water droplets and coalescence thereof. Water droplets also go through deformation due to the induced dipole formation on the droplet surface. Normally the dipole on the surface also contributes to the collision of water droplets by attraction and growth. However, because the application of the alternating electric field also creates shearing force on the brine droplets, it is conceivable that depending on the effectiveness and concentration of natural surfactants present in the water-oil interface, the droplets may even break up and become smaller (emulsify) rather than growing.

Briceno et al U.S. Pat. No. 4,895,641 describes a method of desalting crude oil in which the formation of a high internal phase ratio oil-in-water emulsion is effective in removing hydrophilic impurities, such as salts, from viscous oils. When a high internal phase ratio oil-in-water emulsion is formed, the hydrophilic impurities become concentrated at the thin aqueous film surrounding the oil droplets. By further diluting the high internal phase ratio by adding water and breaking the oil-in-water emulsion, clean crude oil can apparently be obtained. It will be noted that this process involves the use of only oil-in-water emulsions.

The primary object of the present invention is to develop a new simple and inexpensive process for removing chlorides (desalting process) which can reduce the cost of oil products and also improve the safety risks associated with hydrogenating chloride-containing oil under high temperature and pressure.

SUMMARY OF THE INVENTION

The present invention relates to an improved process for desalting (removing chlorides) from crude oils and bitumen. According to the new process there is first added to a salt-containing crude oil a non-ionic oil soluble surfactant. These are mixed and the mixture of crude oil and surfactant is then caused to froth by bubbling a gas through the mixture. After forming the froth, chlorides can be reduced to very low levels by means of only moderate centrifuging. This surprisingly is capable of reducing the chloride level of crude oils-to very low levels of typically less than 2 to 3 ppm.

The frothing step has been found to be essential for the successful operation of the process of this invention. Vigorous mechanical mixing has been unable to replace the gentle mixing and frothing of oil by fine gas bubbles. In order to carry out the frothing, the mixture of crude oil and surfactant is preferably held in a vessel at a temperature in the range of about 40° to 90° C. and gas is bubbled through the mixture from a nozzle or sparger. A gentle flow of gas is preferred for forming the desired froth.

A large variety of different gases may be used to produce the froth, e.g. acidic gases such as hydrogen sulphide, inert gases such as $CO_2$, $N_2$, etc. The frothing can normally be carried out within a period of about 3 to 30 minutes.

The crude oils used in the process of the present invention may be any commercial crude oil, including heavy oils and bitumens. The heavy oils and bitumens are materials typically containing a large amount, e.g. greater than 50%, of material boiling above 524° C. Of particular interest is diluted bitumen which is bitumen or heavy oil diluted with a low viscosity hydrocarbon diluent, such as naphtha. This diluted bitumen typically has an API gravity in the range of about 20 to 35. The typical viscosity range is from Soybolt Universal 500 sec. at 100° F. for °API20 oil to 40 sec. at 100° F. for °API35 oil.

The surfactant that is used in the process of the invention is a non-ionic water soluble surfactant preferably having a low to medium hydrophilic-lipophilic balance, e.g. in the range of about 0.5 to about 10. A surfactant having a medium hydrophil-lipophil balance of about 9 has been found to be particularly effective. The surfactant is preferably present in a concentration in the range of about 0.0125 to 1.0 vol % of the crude oil, with a range of 0.025 to 0.5 vol % being particularly preferred. The preferred surfactants are non-ionic block copolymers of ethylene oxide and propylene oxide, such as those sold by BASF under the trade mark Pluronic®.

The centrifuging can be carried out at relatively moderate gravity, e.g. in the range of about 250 to 500 G. The centrifugation time varies with the level of gravity applied and, for instance, at a moderate gravity of about 250 G the centrifugation time is in the range of about 40 to 120 minutes.

DESCRIPTION OF THE PREFERRED EMBODIMENTS

The invention is further illustrated by reference to the following examples:

Example 1 (Prior Art)

The crude oil used for this test was so called "diluted bitumen" obtained from Syncrude. This is bitumen diluted with naphtha in a naphtha/bitumen weight ratio of about 0.7 and having the following characteristics:

Gravity °API: 26

Density: 0.89 at 25° C.

Viscosity: 7.0 mPa.s at 38° C.

80 ml of the above diluted bitumen containing about 9 ppm chloride were placed in a graduated centrifugation cylinder (approximately 100 ml in capacity). This was centrifuged at a temperature of 70° C. at a speed of 1500 rpm. Grey brownish sediment began to appear after 10 minutes and after 120 minutes of centrifugation, the final sediment height was measured and the product oil was drained from the cylinder. The sediment remained at the bottom of the centrifugation cylinder. Chlorine content of the oil product was analyzed by the neutron activation method and the results are shown in Table 1.

Example 2

80 ml of the chloride-containing diluted bitumen of Example 1 was placed in a 100 ml graduated cylinder. This was heated in an oil bath and hydrogen sulphide gas was passed at 10 cc per minute using a sintered metallic sparger. Frothing of the oil lasted for 30 minutes at 70° C. After the frothing, the sample was placed in a centrifugation cylinder and centrifuged at a temperature of 70° C. and a speed of 1500 rpm for 120 minutes. Upon completion of the centrifugation, the final sedimentation height was measured and the oil product was drained from the cylinder. The chlorine content in the oil product was analyzed by the neutron activation method and the results are shown on the attached Table 1.

Example 3

A series of additional tests were conducted following the procedure of Example 2, while replacing the hydrogen sulphide by $CO_2$ or air. Further tests were conducted in which 0.5 vol % of different commercial surfactants were mixed with the crude oil prior to the frothing and $H_2S$, $CO_2$, air or $NH_3$ was used as frothing gas. The results obtained are all also shown in Table 1.

TABLE 1

| Run ID | Gas | Surfactant | HLB | Surfactant Conc. (vol %) | Final sedimentation (vol %) | Chlorine level in oil (ppm) |
|---|---|---|---|---|---|---|
| Untreated | | | | | 2.5 | 9.10 |
| H2-L | $H_2S$ | None | | | 2.3 | 9.00 |
| H2-F68L | $H_2S$ | F68[1] | 29 | 0.5 | 2.8 | 4.50 |
| H2-P103L | $H_2S$ | P103[2] | 9 | 0.5 | 6.9 | 1.80 |
| H2-L121L | $H_2S$ | L121[3] | 0.5 | 0.5 | 3.8 | 2.70 |
| CO2-91193 | $CO_2$ | None | | | 2.1 | 5.31 |
| CO2L91193 | $CO_2$ | L121 | 0.5 | 0.5 | 5.0 | 2.10 |
| A-91193 | Air | None | | | 2.3 | 4.87 |
| AL-91193 | Air | L121 | 0.5 | 0.5 | 5.6 | 2.10 |
| A28-F68L | $NH_3$ | F68 | 29 | 0.5 | 2.0 | 5.70 |
| A28-P103L | $NH_3$ | P103 | 9 | 0.5 | 2.9 | 4.00 |
| A28-L121L | $NH_3$ | L121 | 0.5 | 0.5 | 3.3 | 5.00 |

[1]BASF Pluronic ® F68 (HLB = 29)
[2]BASF Pluronic ® P103 (HLB = 9)
[3]BASF Pluronic ® L121 (HLB = 0.5)

We claim:

1. A process for removing chlorides from crude oil which comprises (1) mixing with the crude oil a non-ionic surfactant having a hydrophilic-lipophilic balance in the range of about 0.5 to about 10, (2) bubbling a gas into the crude oil-surfactant mixture to form a froth, (3) centrifuging the frothed mixture to obtain a chloride containing sediment and an oil product of reduced chloride content and (4) collecting the oil product.

2. A process according to claim 1 wherein the crude oil is a heavy oil or bitumen.

3. A process according to claim 2 wherein the heavy oil or bitumen is diluted with a low viscosity hydrocarbon diluent.

4. A process according to claim 3 wherein the diluent is naphtha.

5. A process according to claim 4 wherein the diluted bitumen has an API-gravity in the range of about 20 to 35.

6. A process according to claim 1 wherein the frothing gas is an inert gas or an acidic gas.

7. A process according to claim 6 wherein the frothing is carried out with the crude oil at a temperature in the range of about 40° to 90° C.

8. A process according to claim 1 wherein the surfactant is a block copolymer of ethylene oxide and propylene oxide.

9. A process according to claim 8 wherein the surfactant is present in a concentration in the range of about 0.025 to 0.5 vol % based on the amount of crude oil.

10. A process according to claim 1 wherein the surfactant is present in a concentration in the range of about 0.0125 to 1.0 vol % based on the amount of crude oil.

11. A process according to claim 1 wherein the centrifuging is carried out at a rarity in the range of about 250–500 G (gravitational force).

* * * * *